US008056991B2

(12) United States Patent
Hollenstein

(10) Patent No.: US 8,056,991 B2
(45) Date of Patent: Nov. 15, 2011

(54) FURNITURE DRIVE

(75) Inventor: Helmut Hollenstein, Lustenau (AT)

(73) Assignee: Julius Blum GmbH, Höchst (AT)

( * ) Notice: Subject to any disclaimer, the term of this patent is extended or adjusted under 35 U.S.C. 154(b) by 0 days.

(21) Appl. No.: 12/956,011

(22) Filed: Nov. 30, 2010

(65) Prior Publication Data

US 2011/0068669 A1 Mar. 24, 2011

Related U.S. Application Data

(63) Continuation of application No. PCT/AT2009/000231, filed on Jun. 10, 2009.

(30) Foreign Application Priority Data

Jul. 18, 2008 (AT) ..... A 1117/2008

(51) Int. Cl.
*A47B 51/00* (2006.01)

(52) U.S. Cl. ..... 312/312; 312/319.5

(58) Field of Classification Search ..... 312/306, 312/312, 319.4–319.8, 29, 21, 283, 247, 312/327, 325, 328
See application file for complete search history.

(56) References Cited

U.S. PATENT DOCUMENTS

| | | | | |
|---|---|---|---|---|
| 2,382,354 | A * | 8/1945 | Wales | 312/247 |
| 2,592,760 | A * | 4/1952 | Sutera | 312/312 |
| 2,944,540 | A * | 7/1960 | Littell, Jr. | 126/273 A |
| 3,028,209 | A * | 4/1962 | Hinkel et al. | 312/319.7 |
| 3,078,133 | A * | 2/1963 | Schauer | 312/321.5 |
| 5,249,858 | A * | 10/1993 | Nusser | 312/319.6 |
| 5,456,529 | A * | 10/1995 | Cheung | 312/245 |
| 6,523,919 | B1 | 2/2003 | Israelsen et al. | |
| 2002/0084732 | A1 * | 7/2002 | Steadman | 312/246 |
| 2007/0124893 | A1 | 6/2007 | Brustle | |
| 2007/0241650 | A1 * | 10/2007 | Schmitt | 312/312 |
| 2009/0064457 | A1 | 3/2009 | Brustle | |

FOREIGN PATENT DOCUMENTS

| | | | |
|---|---|---|---|
| AT | 7290 | | 1/2005 |
| EP | 1 692 967 | | 8/2006 |
| JP | 11-60196 | | 3/1999 |
| JP | 2001-120366 | | 5/2001 |
| JP | 2002262947 | * | 9/2002 |
| JP | 2003125859 | * | 5/2003 |
| WO | 03/097457 | | 11/2003 |
| WO | 2006/005086 | | 1/2006 |
| WO | 2007/131251 | | 11/2007 |

OTHER PUBLICATIONS

International Search Report issued Mar. 10, 2010 in International (PCT) Application No. PCT/AT2009/000231.
Austrian Patent Office Search Report completed Apr. 28, 2009 in Austrian Patent Application No. A 1117/2008.

* cited by examiner

*Primary Examiner* — Janet M Wilkens
(74) *Attorney, Agent, or Firm* — Wenderoth, Lind & Ponack, L.L.P.

(57) ABSTRACT

A furniture drive for moving a furniture part is mounted in a vertically adjustable manner includes a drive apparatus, which has an electric motor, for moving the movable furniture part, and includes a compensation device which exerts a force which is opposite to the weight force on the movable furniture part. A measuring device is provided for detecting the weight of the movable furniture part. Therefore, the force exerted by the compensation device on the movable furniture part can be variably adjusted as a function of the measured weight of the movable furniture part by an adjusting device which has a further electric motor and can be actuated by the measuring device.

20 Claims, 7 Drawing Sheets

FURNITURE DRIVE

This application is a Continuation of International application No. PCT/AT2009/000231, filed Jun. 10, 2009, the entire disclosure of which is incorporated herein by reference.

BACKGROUND OF THE INVENTION

The present invention concerns a furniture drive for moving a furniture part which is mounted displaceably in respect of height, comprising a drive device having an electric motor for moving the movable furniture part and a compensation device which exerts on the movable furniture part a force opposite to the force due to weight.

In addition, the invention concerns an article of furniture having a furniture drive of the kind to be described.

With such furniture drives, a frequent problem is that of ensuring a harmonic pattern of movements even in different loaded conditions of the movable furniture part. More specifically, if the movable furniture part is subject to differing loadings due to items accommodated therein, then the drive device must also apply forces of differing magnitude to the movable furniture part. That, however, requires an electric drive which ensures a dynamic movement of the movable furniture part even at maximum loading. To keep down the power dimensions of the drive device, there is provided a compensation device which exerts a force opposite to the force due to weight, on the movable furniture part, so that the electric drive can be at least partially relieved of load thereby.

The object of the present invention is to propose a furniture drive of the general kind referred to in the opening part of this specification, which even with different loading conditions of the movable furniture part, permits a uniform regular pattern of movement.

SUMMARY OF THE INVENTION

In an advantageous configuration according to the invention, the object is achieved in that there is provided a measuring device for detecting the weight of the movable furniture part so that the force exerted by the compensation device on the movable furniture part is variably adjustable depending on the measured weight of the movable furniture part by an adjusting device which has a further electric motor and which is actuated by the measuring device.

In that way, a force opposite to the force due to weight is applied to the movable furniture part, and that force is actively variable depending on the respective loading condition of the movable furniture part. In that way, the drive device can be supported with different compensation forces so that the power dimensions of the drive device can be relatively small. By virtue of the compensation device which is variable in terms of its force, the drive device only has to apply comparatively low forces for raising and lowering the movable furniture part.

The force of the compensation device is to be applied to the movable furniture part therefore adjustable in accordance with the detected weight of the movable furniture part, in variable fashion. Basically, it is possible to use any device which is provided for determining the weight of the movable furniture part, as the measuring device. In that respect, mention may be made in particular of force pickups or force sensors which can detect both pressure and also traction forces. It is equally possible to use measuring devices for detecting rotary moments. The movement applied to the measuring device can be effected both in rotational mode and/or in sliding mode by pressure or traction loading.

In accordance with a preferred embodiment, the measuring device for detecting the weight of the movable furniture part can include at least one force measuring cell which is known from the state of the art and by which a force signal corresponding to the weight of the movable furniture part can be fed to the compensation device. Such force measuring cells are commercially available and permit long service lives which are practically maintenance-free. Mounting forces, rotary moments or contact support forces can be reliably, quickly and exactly detected by means of such force measuring cells.

In accordance with the invention, it is therefore provided that the compensation device includes at least one adjusting device having an electric motor, wherein the adjustment device is actuated by the measuring device. In principle, the electric motor of the adjustment device can apply the forces required for weight compensation directly to the movable furniture part. In a preferred embodiment of the invention, however, it may be desirable if the compensation device has a spring device, wherein the biasing of the spring device is variably adjustable by a displacement—preferably by electric motor means. In this connection, it may also be desirable if the spring device has a spring mounting, wherein the position of the spring mounting is adjustable by the adjustment device so that the biasing of the spring device can also be varied in that way.

In other words, the electric motor of the compensation device can be in the form of an adjusting motor for the spring device, wherein the electric motor provides for different biasing of the spring device depending on the detected weight. The spring device of the compensation device can be formed both by mechanical spring elements and also by at least one gas pressure spring which operate on the movable furniture part by way of a lever arrangement. The electric motor which influences the compensation device in terms of force can adjust the effective lever arm length of the lever arrangement or adjust the position of the spring device, in positionally variable relationship.

In advantageous development of the invention it can be provided that the compensation device has an actuating arm for acting on the movable furniture part, wherein a transmission mechanism converts a movement of the spring device into a pivotal movement of the actuating arm. For that purpose, the transmission mechanism can have a lever mechanism and/or a rotatable control cam with an adjusting contour. Desirably in this connection, it is possible to use all actuating mechanisms which are known in the state of the art and which are provided for moving upwardly movable furniture flaps. WO 2006/005086 A1 is to be mentioned as an example of such an actuating mechanism.

The actual drive device can act on the movable furniture part by way of a transmission mechanism, wherein the transmission mechanism can have at least one cable line and/or toothed racks with pinions and/or a toothed belt drive. In principle, the person skilled in the relevant art can take all precautions and measures known in the state of the art for embodying the transmission mechanism, whether by means of a spindle drive, by means of a hydraulic drive or a pneumatic drive, and so forth.

In addition, it may be desirable if the furniture drive has at least one position measuring device which produces a position signal which is characteristic of the opening condition of the movable furniture part and which can be fed to a regulating device. The position signal which is made available in that way can serve for calculation of the instantaneous actual position and/or the instantaneous actual speed and/or the instantaneous actual value of the acceleration or deceleration of the movable furniture part as a function of the measured position.

The article of furniture according to the invention is characterized by at least one furniture drive of the kind in question.

BRIEF DESCRIPTION OF THE DRAWINGS

Further details and advantages of the invention are described with reference to the specific description hereinafter. In the drawings.

DETAILED DESCRIPTION OF THE INVENTION

Figure 1:
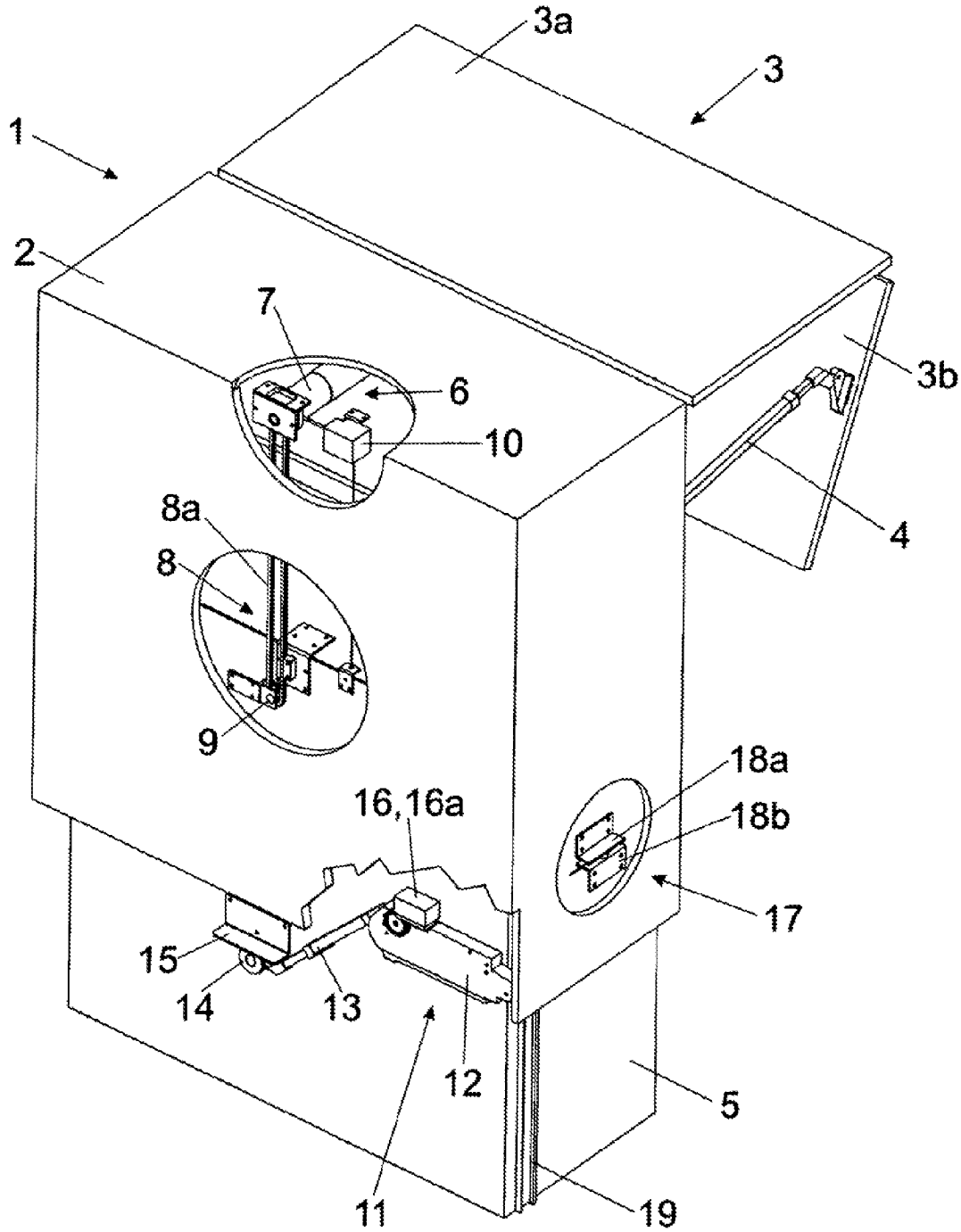
FIG. 1 is a partly broken-away perspective view from the rear of an article of furniture according to the invention.

FIG. 1 shows a perspective view from the rear of a possible embodiment of an article of furniture 1 according to the invention, the article of furniture 1 being shown as a partly broken-away view in order better to display the units involved. The article of furniture 1 has a furniture carcass 2 in cabinet form, the cabinet compartment of which can be closed by an upwardly pivotable furniture flap 3. The furniture flap 3 is in the form of an upwardly folding flap with two flap portions 3*a* and 3*b* which can be folded together, wherein the upper flap portion 3*a* is pivotable about a horizontal axis relative to the furniture carcass 2, and the lower flap portion 3*b* is pivotable about a second horizontal axis relative to the upper flap portion 3*a*. To move the furniture flap 3, there is provided at least one pivotable actuating arm 4 which is acted upon by a spring device (not shown) to provide for weight compensation of the furniture flap 3. However what is of substantial significance is the furniture part 5 which is displaceable in respect of height and which in the illustrated embodiment is in the form of a cabinet-form carcass portion arranged at least region-wise within the stationary furniture carcass 2. In the Figure, the furniture part 5 is adapted to be vertically displaceable relative to the furniture carcass 2 along a linear path of movement so that the furniture part 5 which can be moved downwardly can be loaded or unloaded with articles to be accommodated therein, in the lowered position, whereupon the movable furniture part 5 can be moved back into the raised parking position again. To move the downwardly movable furniture part 5, there is provided a drive device 6 having at least one electric motor 7 which acts on the direction-changing roller 9 mounted on the downwardly movable furniture part 5, by way of a transmission mechanism 8 (preferably a toothed belt 8*a*). In addition, there is provided a diagrammatically illustrated position measuring device 10 for the downwardly movable furniture part 5. The device 10 can include, for example, a limit switch for detecting a limit position of the downwardly movable furniture part 5. It is possible to see a compensation device 11 which is secured to the furniture carcass 2 and which exerts on the downwardly movable furniture part 5 a force which is in opposite relationship to the force due to weight. In other words, the downwardly movable furniture part 5 is urged upwardly by the compensation device 11 to relieve the load on the drive device 6. The compensation device 11 includes a housing 12 in which there is arranged a spring device (not shown in greater detail here) for at least partial compensation of the weight of the downwardly movable furniture part 5. The compensation device 11 further includes an adjusting arm 13 which is mounted to the pivotable housing 12 and which can be acted upon by the spring device arranged in the housing 12. Mounted at the end of the adjusting arm 13 is a roller 14 which can run on a fitment member 15 associated with the downwardly movable furniture part 5. The compensation device 11 further includes an adjustment device 16 having an electric motor 16*a*, wherein the biasing of the spring device in the housing 12 can be variably adjusted by that adjustment device 16. The adjustment device 16 is now actuated by a measuring device 17 for detecting the weight of the downwardly movable furniture part 5 so that the spring biasing of the compensation device 11 can be automatically adjusted in accordance with the detected weight of the movable furniture part 5. The measuring device 17 includes a mounting member 18*a* associated with the downwardly movable furniture part 5 and a mounting member 18*b* associated with the furniture carcass 2. A commercially available force measuring cell operates between the mounting members 18*a* and 18*b* so that the contact force of the movable mounting member 18*a* (that is to say the weight of the downwardly movable furniture part 5) on the stationary mounting member 18*b* can be detected.

It should be noted that in the illustrated embodiment, for reasons of simplicity, measurement of the force due to weight is effected in the lowermost limit position of the downwardly movable furniture part 5. In that way, a corresponding control signal is fed to the compensation device 11, for adjusting the compensation force. In a preferred development of the invention, the weight of the downwardly movable furniture part 5 is continuously detected whereby a continuous control signal can be fed to the electric motor 16*a* of the adjustment device 16 for dynamic adjustment of the compensation force.

Provided for linear guidance of the downwardly movable furniture part 5 relative to the furniture carcass 2 are rails 19 mounted at both sides of the downwardly movable furniture part 5. It is to be noted that the furniture part 5 is not only vertically movable relative to the furniture carcass 2 but—in a possible variant—can also be lowered into a pivoted position of being moved further downwardly.

Figure 2:
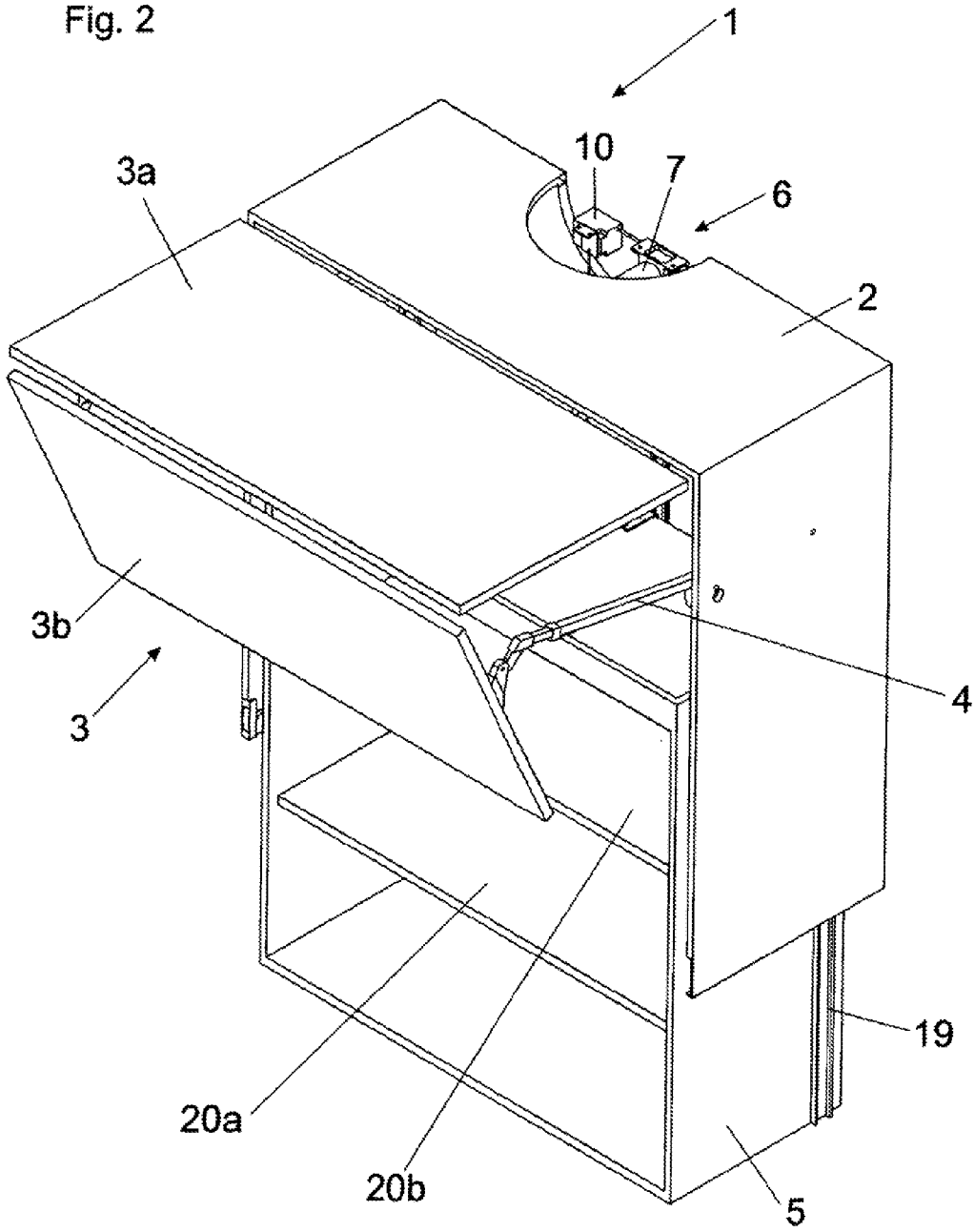
FIG. 2 is a perspective view from the front of the FIG. 1 article of furniture.

FIG. 2 shows a perspective view from the front of the article of furniture 1 of FIG. 1. It is possible to see therein the drive device 6 having the electric motor 7 and the position measuring device 10. The drive device 6 is preferably of a self-locking design so that the movable furniture part 5 is held practically in any heightwise position. The furniture flap 3 with the flap portions 3*a* and 3*b* is moved by way of the actuating arm 4. The downwardly movable furniture part 5 can be coupled in respect of motion to the furniture flap 3 (by electrical and/or mechanical means) so that, when the furniture flap 3 is opened or closed, the downwardly movable furniture part 5 also moves. More desirably, however, the movement of the downwardly movable furniture part 5 can be triggered separately by a push button switch (not shown). The downwardly movable furniture part 5 has compartment shelves 20*a* and 20*b* which are provided for supporting additional items to be accommodated therein. The compensation device 11 shown in FIG. 1 is influenced in respect of force by the different loading conditions of the downwardly movable furniture part 5 so that the movable furniture part 5 is preferably always moved with the same acceleration or deceleration, independently of the loading condition.

Figure 3:
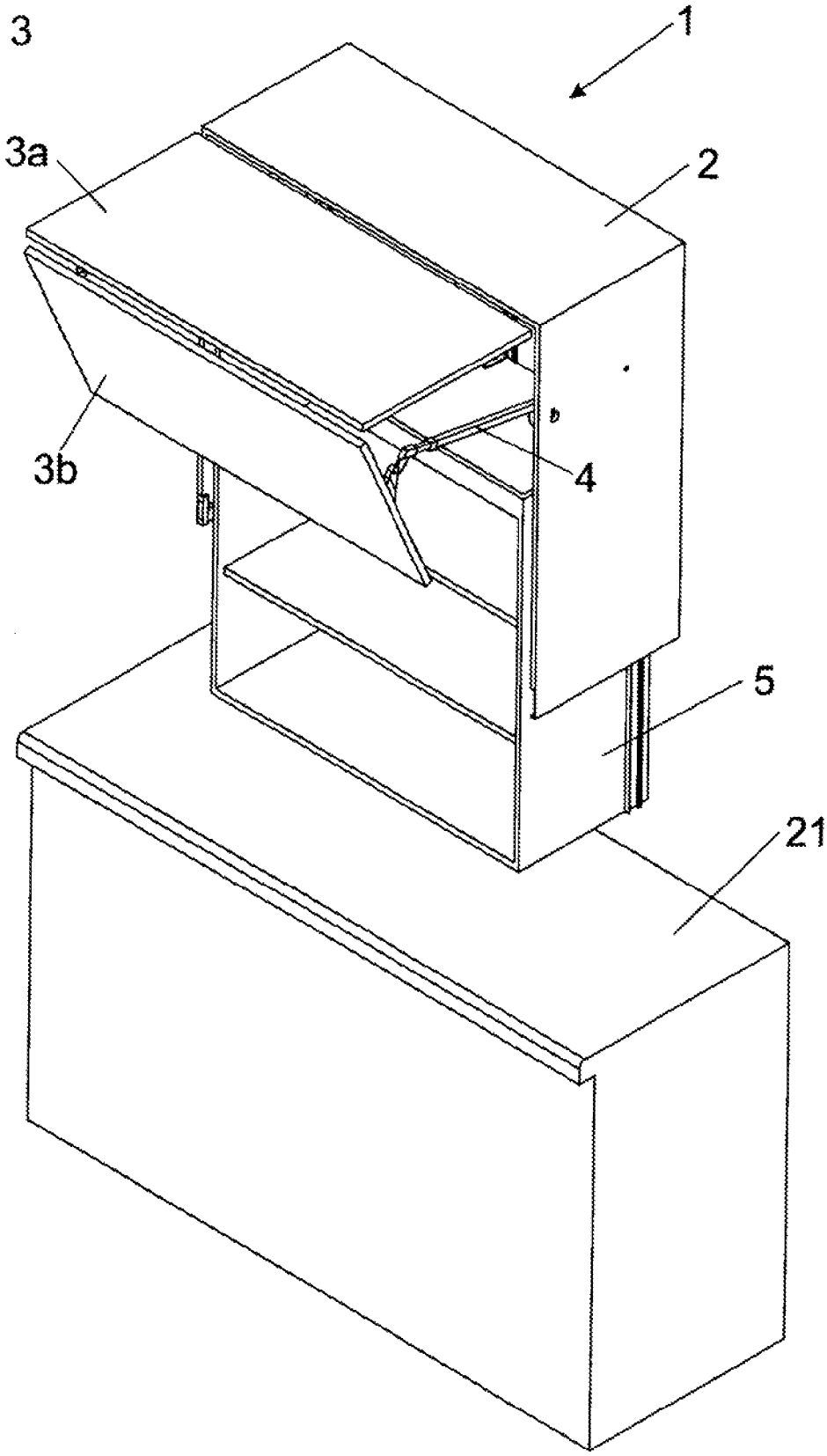
FIG. 3 shows a typical installation position of the furniture with the furniture part lowered.

FIG. 3 shows a typical installation situation of an article of furniture 1 according to the invention which is suitable, in particular, as a wall cabinet in kitchens. The furniture carcass 2 is mounted stationarily above a worktop 21, and the movable furniture part 5 is substantially completely accommodated in the furniture carcass 2 in a first limit position but (if required) can be moved downwardly into a lower second limit position. In that way, possible items to be accommodated therein can be easily introduced thereinto or removed, whereupon the furniture part 5 is movable upwardly again into the space-saving first limit position.

Figure 4:
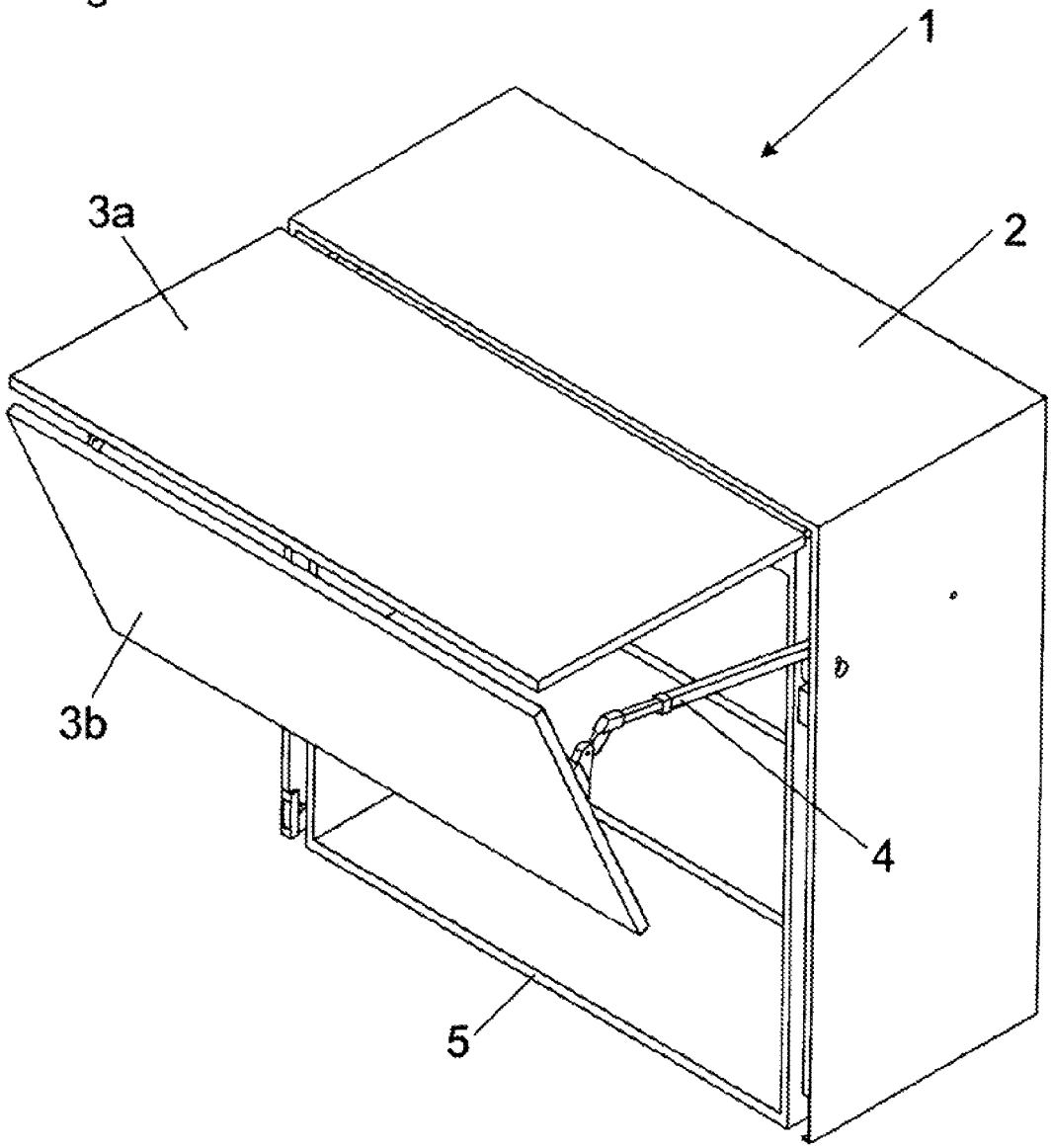
FIG. 4 shows the article of furniture with the furniture part retracted.

FIG. 4 shows the article of furniture 1, wherein the movable furniture part 5 is in the uppermost limit position relative to the furniture carcass 2. Starting from that illustration, the two flap portions 3*a* and 3*b* are movable into a vertical position so that the flap portions 3*a* and 3*b* substantially completely close the cabinet compartment formed by the movable furniture part 5, in the vertical position.

Figure 5A:
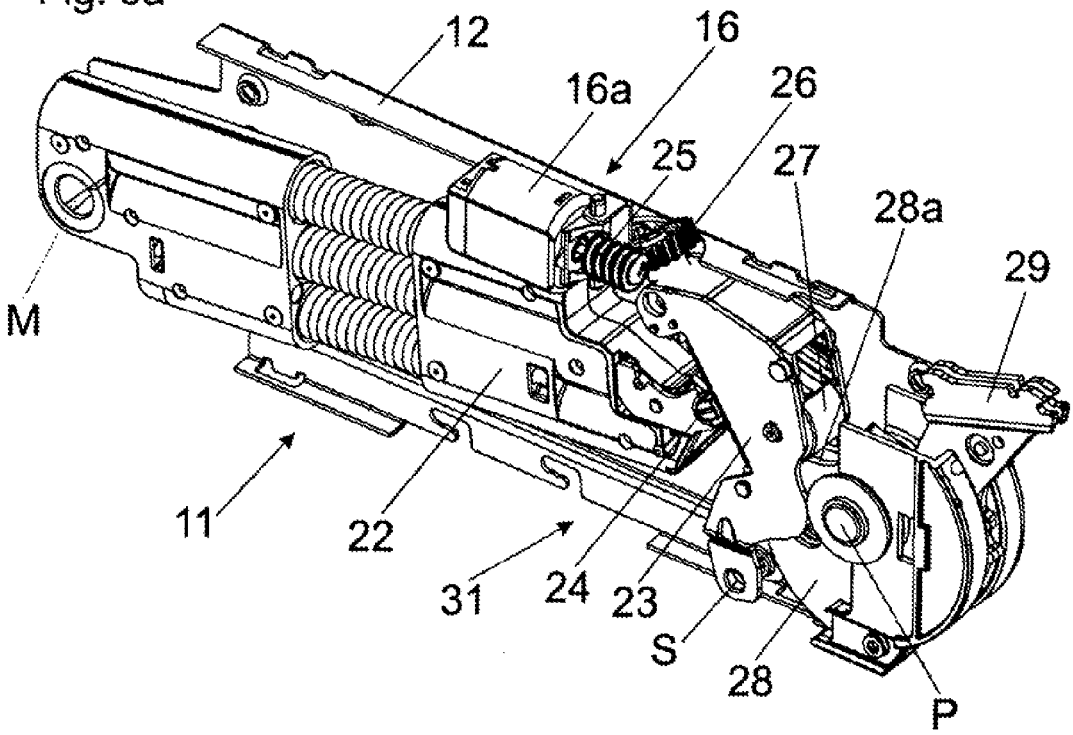
FIGS. 5*a*, 5*b* show a possible embodiment of a compensation device as a perspective view and a part of a side view in relation thereto.
Figure 5B:
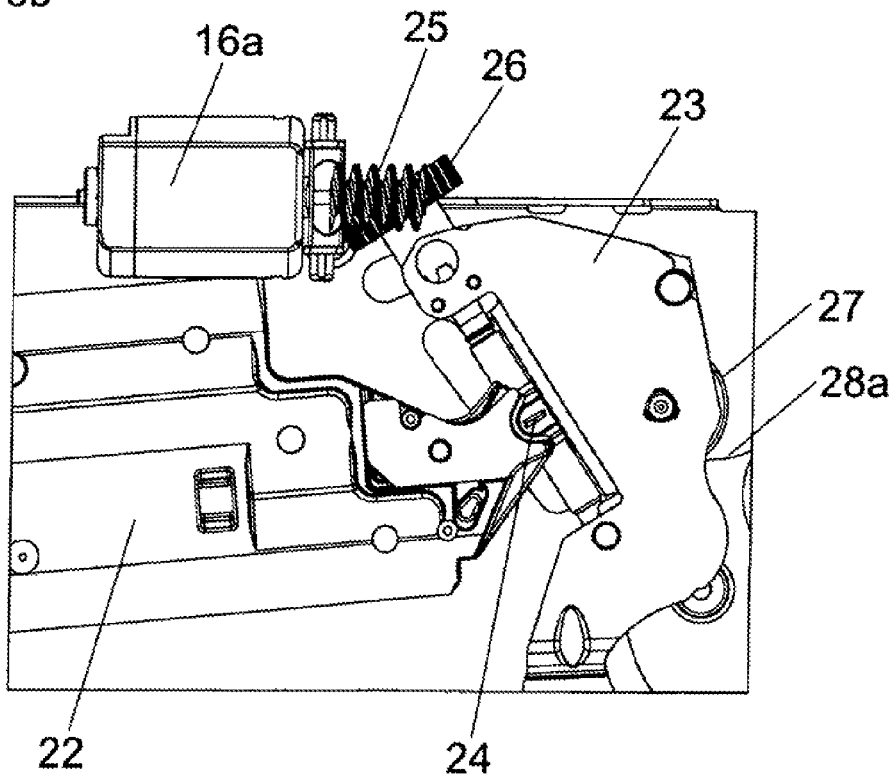

FIG. 5*a* shows a perspective view of a possible configuration of a compensation device 11. The compensation device 11 includes a spring device 22 mounted movably about a pivot point M. The spring device 22 acts on an intermediate lever 23 mounted at the pivot point S, wherein the spring mounting 24 of the spring device 22 on the intermediate lever 23 is displaceable by way of the displacement device 16. Due to a change, caused thereby, in the spacing between the spring mounting 24 and the pivot point S of the intermediate lever 23, besides the altered spring biasing, that also gives modified lever relationships. Accordingly, the torque acting on the adjusting arm 13 (not shown here) can be selectively adjusted by the adjustment device 16 in accordance with the respective weight of the downwardly movable furniture part 5. The adjustment device 16 has an electric motor 16*a*, the displacement movement of which is controllable by the measuring device 17 (FIG. 1). The spring mounting 24 is movable along a spindle arranged on the intermediate lever 23, a worm gear 26 being arranged at the upper end of the spindle. The electric motor 16*a* includes a worm 25 which displaces the worm gear 26 whereby the spring mounting 24 of the spring device 22 can be set at a variable spacing relative to the pivot point S of the intermediate lever 23. Mounted on the intermediate lever 23 is a pressure roller 27 which can run along an adjusting contour 28*a* of a control cam 28 mounted at the pivot point P during the pivotal movement of the adjusting arm 13. The control cam 28 has a coupling member 29 which can be releasably connected to the adjusting arm 13, preferably by latching engagement. FIG. 5*b* shows a portion of the adjustment device 16 as a side view on an enlarged scale. A rotary movement of the electric motor 16*a* is converted by way of the worm 25 and the worm gear 26 into a rotary movement of the spindle, on which the spring mounting 24 is mounted. That permits displacement of the spring mounting 24 of the spring device 22 along the intermediate lever 23. Reference 31 (FIG. 5*a*) identifies in its entirety a transmission mechanism which converts a movement of the spring mounting 24 into a pivotal movement of the adjusting arm 13.

Figure 6:
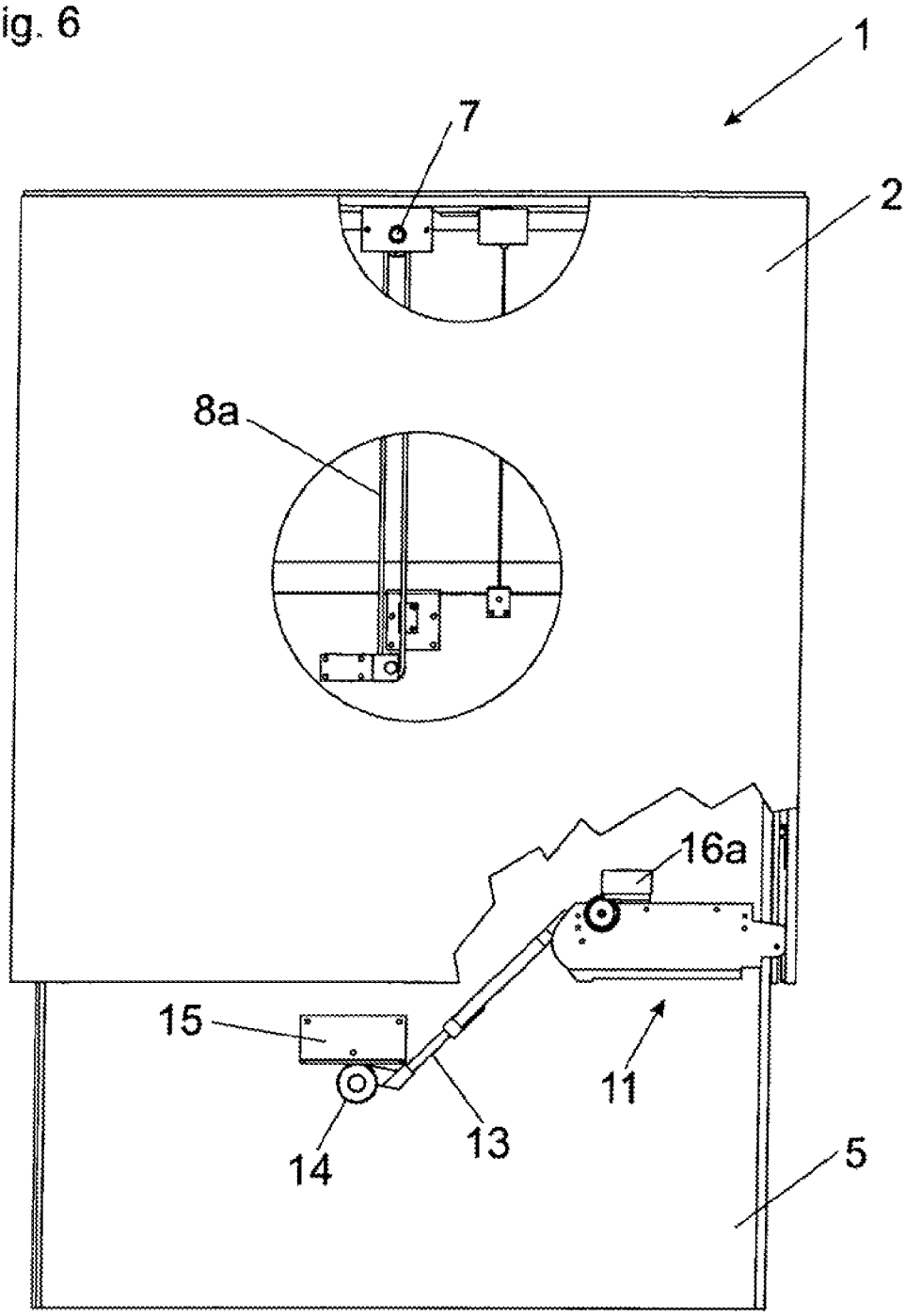
FIG. 6 shows a partly broken-away view of the article of furniture from the rear.

FIG. 6 shows a partly broken-away rear view of the article of furniture 1, showing the stationary furniture carcass 2 and the furniture part 5 which is downwardly movable relative thereto. The drive device 6 with the electric motor 7 moves the furniture part 5 in the form of a carcass, by way of a toothed belt 8*a*. It is also possible to clearly see the compensation device 11 which is mounted to the stationary furniture carcass 2 and the compensation force of which is adjustable by way of the further electric motor 16*a*. The downwardly movable furniture part 5 has an angled fitment member 15, against which the roller 14 mounted on the adjusting arm 13 comes to bear and thus relieves the load on the electric motor 7 of the drive device 6 in accordance with the respective weight of the furniture part 5.

Figure 7:
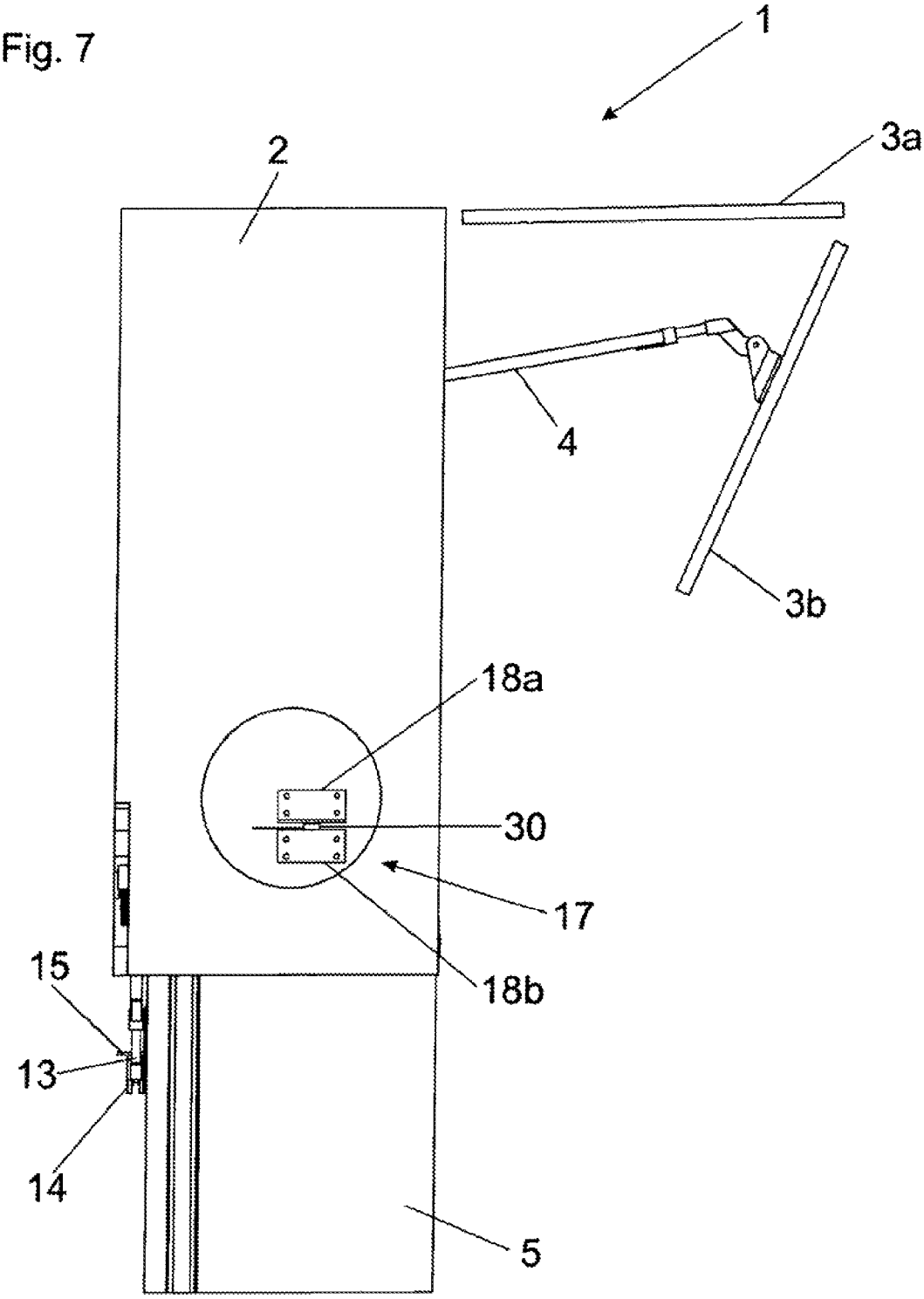
FIG. 7 shows a partly broken-away side view of the article of furniture.

FIG. 7 shows a side view of the article of furniture 1. A measuring device 17 is provided to detect the weight of the downwardly movable furniture part 5. The upper mounting member 18*a* is associated with the downwardly movable furniture part 5 while the lower mounting member 18*b* is mounted to the stationary furniture carcass 2. Reference 30 indicates by way of example a force measuring cell which detects the contact force of the mounting member 18*a* (that is to say the overall weight of the downwardly movable furniture part 5), whereupon a corresponding compensation force in opposite relationship to the force due to the weight is applied to the downwardly movable furniture part 5.

The present invention is not limited to the illustrated embodiment but includes or extends to all variants and technical equivalents which can fall within the scope of the claims appended hereto. The positional references adopted in the description such as for example up, down, lateral and so forth are also related to the usual position of installation and to the directly described and illustrated Figure and are to be appropriately transferred to the new position upon a change in position. It is to be noted that all components of the furniture drive according to the invention can also be arranged in a common unit, thereby giving a particularly compact unit.

The invention claimed is:

1. An article of furniture comprising:

a furniture carcass;

a movable furniture part mounted to said furniture carcass so as to be displaceable with respect to a height of said furniture carcass; and a furniture drive including:

a drive device having a first electric motor for moving said movable furniture part;

a compensation device for exerting a variable compensating force on said movable furniture part, the variable compensating force being a force opposite to a force due to a weight of said movable furniture part;

a measuring device for detecting the weight of said movable furniture part; and an adjustment device for adjusting the variable compensating force from said compensation device depending on the detected weight of said movable furniture part by said measuring device, said adjustment device having a second electric motor to be actuated by said measuring device.

2. The article of furniture of claim 1, wherein said measuring device for detecting the weight of said movable furniture part includes a force measuring cell, said force measuring cell being configured to generate a force signal corresponding to the weight of said movable furniture part and feed the force signal to said compensation device.

3. The article of furniture of claim 2, wherein said drive device has a transmission mechanism for operating on said movable furniture part.

4. The article of furniture of claim 3, wherein said transmission mechanism includes a toothed belt.

5. The article of furniture of claim 1, wherein said compensation device has a spring device, said adjustment device being configured to adjust a biasing of said spring device.

6. The article of furniture of claim 5, wherein said spring device has a spring mounting, said furniture drive further including a displacement device for moving a position of said spring mounting so as to vary the biasing of said spring device.

7. The article of furniture of claim 5, wherein said compensation device has an adjusting arm for moving said movable furniture part, said furniture drive further including a transmission mechanism for converting a movement of said spring device into a pivotal movement of said adjusting arm.

8. The article of furniture of claim 7, wherein said adjusting arm has a roller configured to roll against said movable furniture part or against a fitment member attached to said movable furniture part.

9. The article of furniture of claim 1, wherein said furniture drive further includes a position measuring device configured to generate a position signal characteristic of an opening condition of said movable furniture part.

10. The article of furniture of claim 1, wherein said movable furniture part comprises a cabinet portion arranged within said furniture carcass.

11. The article of furniture of claim 1, wherein said movable furniture part is pivotable and/or linearly movable with respect to said furniture carcass.

12. A furniture drive comprising:

a drive device having a first electric motor for moving a movable furniture part movably mounted to a furniture carcass;

a compensation device for exerting a variable compensating force on the movable furniture part, the variable compensating force being a force opposite to a force due to a weight of the movable furniture part;

a measuring device for detecting the weight of the movable furniture part; and an adjustment device for adjusting the variable compensating force from said compensation device depending on the detected weight of the movable furniture part by said measuring device, said adjustment device having a second electric motor to be actuated by said measuring device.

13. The furniture drive of claim 12, wherein said measuring device for detecting the weight of the movable furniture part includes a force measuring cell, said force measuring cell being configured to generate a force signal corresponding to the weight of the movable furniture part and feed the force signal to said compensation device.

14. The furniture drive of claim 13, wherein said drive device has a transmission mechanism for operating on the movable furniture part.

15. The furniture drive of claim 14, wherein said transmission mechanism includes a toothed belt.

16. The furniture drive of claim 12, wherein said compensation device has a spring device, said adjustment device being configured to adjust a biasing of said spring device.

17. The furniture drive of claim 16, wherein said spring device has a spring mounting, said furniture drive further including a displacement device for moving a position of said spring mounting so as to vary the biasing of said spring device.

18. The furniture drive of claim 16, wherein said compensation device has an adjusting arm for moving the movable furniture part, said furniture drive further including a transmission mechanism for converting a movement of said spring device into a pivotal movement of said adjusting arm.

19. The furniture drive of claim 18, wherein said adjusting arm has a roller configured to roll against the movable furniture part or against a fitment member attached to the movable furniture part.

20. The furniture drive of claim 12, wherein said furniture drive further includes a position measuring device configured to generate a position signal characteristic of an opening condition of the movable furniture part.

* * * * *